United States Patent [19]

Willis

[11] 4,454,954

[45] Jun. 19, 1984

[54] BALL HOUSING FOR A NONREFILLABLE POUR FITMENT

[75] Inventor: W. Coy Willis, Hagerstown, Ind.

[73] Assignee: Aluminum Company of America, Pittsburgh, Pa.

[21] Appl. No.: 470,477

[22] Filed: Feb. 28, 1983

[51] Int. Cl.[3] ..... B65D 49/02

[52] U.S. Cl. ..... 215/21

[58] Field of Search ..... 215/21, 22, 23, 26, 215/28

[56] References Cited

U.S. PATENT DOCUMENTS

| | | | |
|---|---|---|---|
| 2,378,919 | 6/1945 | Fisher | 215/21 |
| 2,850,192 | 9/1958 | Lepri | 215/21 |
| 3,073,470 | 1/1963 | Greene | 215/22 |
| 3,861,548 | 1/1975 | Bereziat | 215/22 |

*Primary Examiner*—Donald F. Norton

*Attorney, Agent, or Firm*—Max L. Williamson

[57] ABSTRACT

A housing for a ball in a nonrefillable pour fitment for assembly with a bottle having an open mouth to prevent fraudulent refilling of the bottle. The housing is comprised of a hollow cylinder adapted for assembly with the bottle and a cup-shaped ball enclosure contained within the cylinder, the enclosure having a diameter or greatest dimension across the cup mouth less than the inside diameter of the hollow cylinder. The ball enclosure is coaxially disposed within the cylinder with the cup mouth recessed inwardly from the cylinder end to be directed toward the interior of the bottle when assembled with the bottle. The enclosure is maintained in a spaced relationship between the cylinder wall and the cup wall defining the cup mouth by a plurality of bridges connecting portions of the cylinder wall with portions of the cup wall defining and projecting away from the cup mouth.

15 Claims, 12 Drawing Figures

BALL HOUSING FOR A NONREFILLABLE POUR FITMENT

BACKGROUND OF THE INVENTION

This invention relates to a nonrefillable pour fitment adapted to assemble with an open-mouthed bottle to permit dispensing liquids from the bottle and prevent fraudulent refilling thereof. More particularly, it relates to a housing to contain and enclose a ball in a fitment which utilizes a ball check valve.

A number of fitments having ball check valves therein and adapted to assemble with an open-mouthed bottle to prevent fraudulent filling thereof are known, such as Lepri U.S. Pat. No. 2,850,192; Greene U.S. Pat. No. 3,073,470 and Bereziat U.S. Pat. No. 3,861,548, for example.

Each of the above patents describes a nonrefillable pour fitment that is adapted to assemble with the open mouth of a bottle and, when so assembled, one or more balls provided within the fitment function in cooperation with other elements of the fitment to prevent the introduction of a liquid into the bottle.

Each of the above patents describes fitments, however, which require the assembly of a number of separate parts, include valves which are susceptible to manipulation to facilitate fraudulent filling of the bottle, or feature valves which may stick and become inoperative if syrupy or other sticky liquids are dispensed through the fitment.

It would be desirable, therefore, to provide a nonrefillable pour fitment for assembly with a bottle which is comprised of a minimum of parts, provides a valve which is not apt to become stuck or inoperable, and is not susceptible to manipulation of its parts to permit fraudulent refilling of the bottle.

BRIEF SUMMARY OF THE INVENTION

A housing of this invention is comprised of a hollow cylinder adapted for assembly with a bottle, a cup-shaped ball enclosure having an open end coaxially disposed within the cylinder with the cup wall spaced apart from the cylinder side wall by a plurality of bridges connecting the side wall of the enclosure with the interior wall surface of the cylinder and with the open end of the enclosure recessed inwardly from the cylinder end to be disposed toward the bottle interior. The cup wall of the enclosure is adapted to prevent the passage therethrough of a ball contained within the enclosure. In the assembly of the housing with the bottle, a ball of a lesser diameter than the diameter or smallest dimension across the open end of the enclosure is provided and held within the enclosure by a valve seat in the following manner. The valve seat having a central opening of a smaller diameter than the ball is spaced apart from the open end of the enclosure and means is provided to maintain the valve seat in the assembly of the fitment to the bottle in coaxial alignment with the enclosure so as to close off any access to the bottle interior through the fitment, except through the valve seat central opening, and to provide a seat for the ball across the central opening when the bottle is in an upright position.

In use of the fitment, when the bottle is tilted to dispense liquid therefrom, the ball, under the force of gravity, rolls away from the valve seat exposing the opening therein. Liquid from within the bottle then flows through the valve seat opening, passes through the space separating the enclosure from the housing and then out the housing opening. The ball is contained within the enclosure so as to prevent its interference with the passage of liquid. After the desired amount of liquid has been dispensed from the bottle, and as the bottle is returned to its upright position, the ball, under the influence of gravity, rolls to seat once again on the valve seat opening.

It is an object of the invention to provide a nonrefillable pour fitment which is comprised of only a minimal number of parts.

It is also an object of this invention to provide a nonrefillable pour fitment having a valve which will prevent fraudulent refilling of a bottle and which will remain operative to permit dispensing of syrupy or sticky liquids contained within the bottle.

A further object of this invention is to provide a nonrefillable pour fitment which is not susceptible to manipulation of its parts when assembled with a bottle to permit fraudulent refilling of the bottle.

These and other objects and advantages of this invention will be more readily apparent with reference to the following description of a preferred embodiment and the appended drawings.

DESCRIPTION OF A PREFERRED EMBODIMENT

Figure 1:
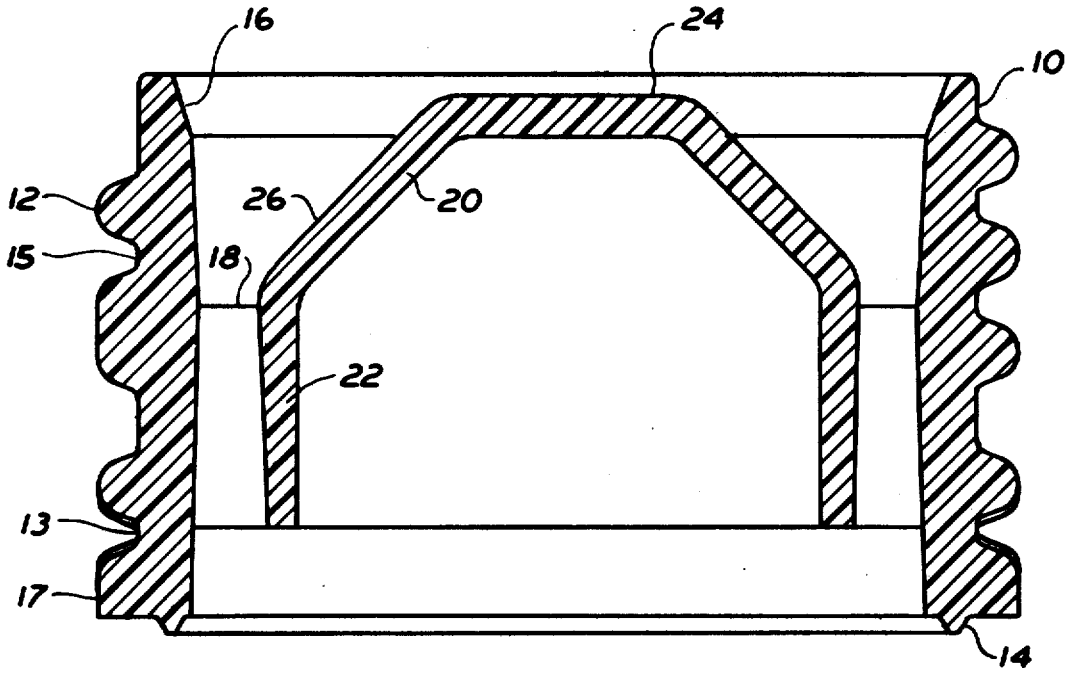
FIG. 1 is a cross-sectional view of a housing element of a fitment of this invention with a ball check enclosure disposed within and spaced apart from the housing with bridge connectors.
Figure 2:
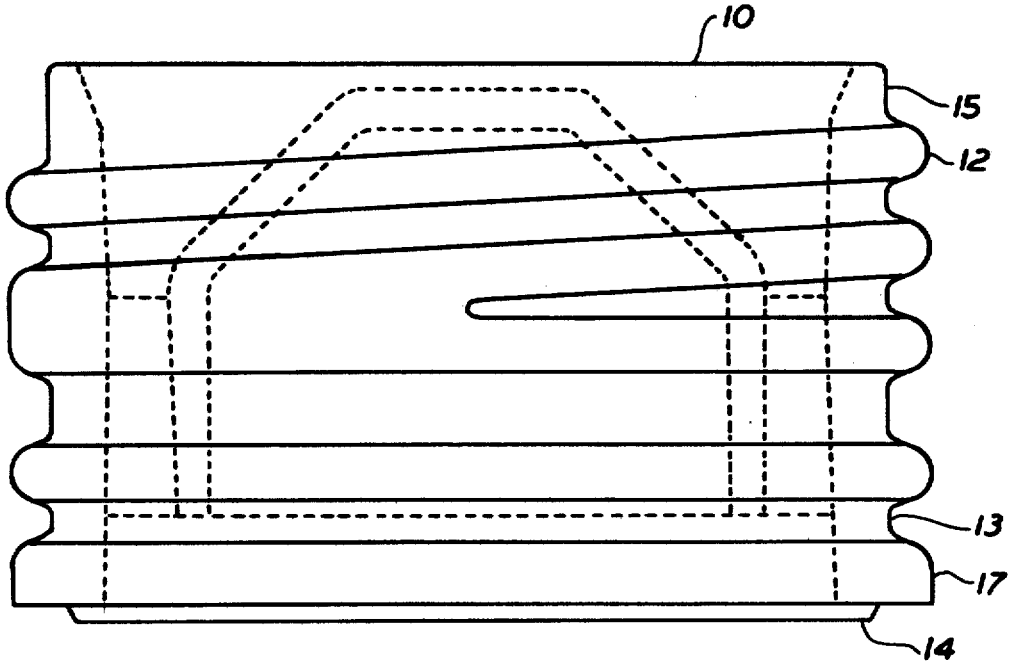
FIG. 2 is a side view of the housing shown in FIG. 1.
Figure 3:
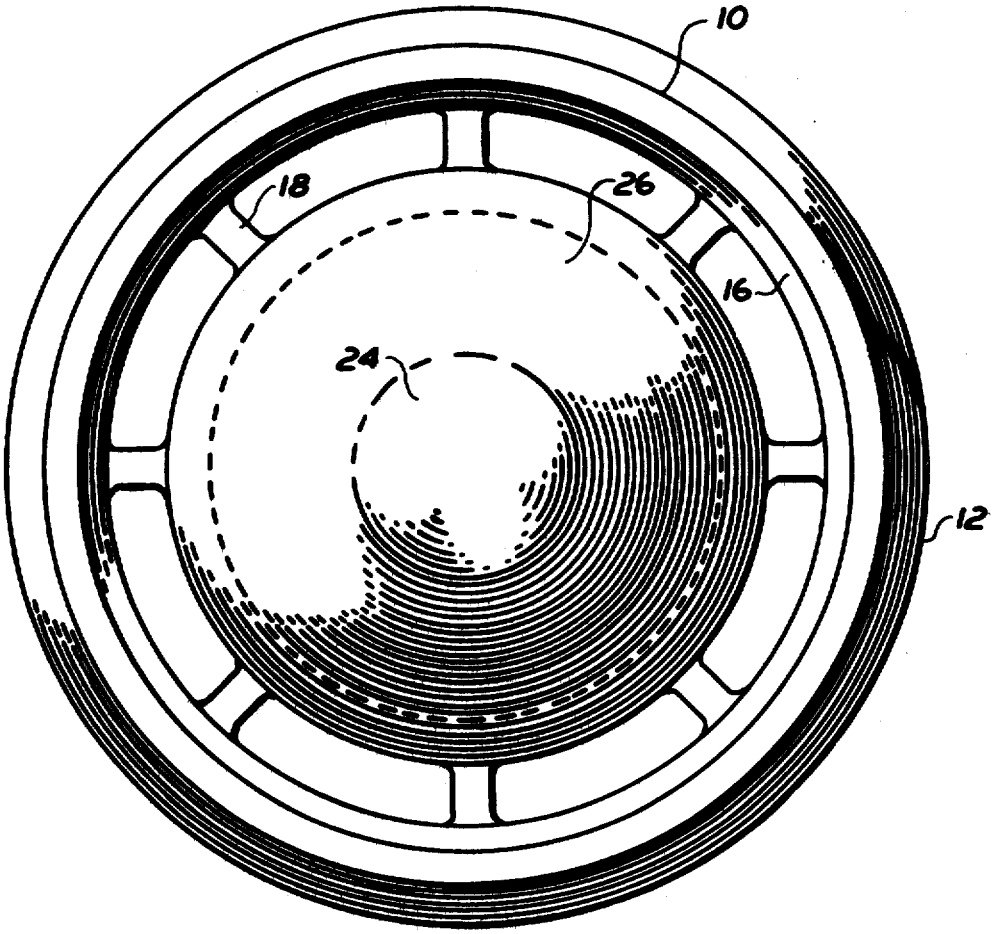
FIG. 3 is a top view of the housing and ball check enclosure shown in FIG. 1.

A preferred embodiment of a nonrefillable pour fitment of this invention is comprised of a hollow cylinder 10, a ball enclosure 20, a ball 30 and a ball check valve seat 40.

Referring to FIGS. 1, 2, 3, 4 and 5, the hollow cylinder 10 is provided with a spiral thread 12 projecting outwardly from the outer cylinder wall surface of an upper portion 15. In a lower portion 17, an annular groove 13 is provided for a purpose to be explained later. An annular wedge 14 projecting outwardly from a portion of an end surface of the lower portion 17 of the cylinder is provided to engage the ball check valve seat 40, as will be explained later. A portion of the inner surface 16 near the dispensing end of the cylinder slopes outwardly to facilitate pouring liquid from the bottle with which the fitment assembles, as will be explained later.

The ball enclosure 20 is a cup-shaped element having an essentially cylindrical side wall 22, a circular planar end wall 24, and a frustoconical wall 26 sloping inwardly and upwardly from an end of the side wall toward and connecting with the peripheral edge of the end wall 24. The enclosure 20 is disposed within the cylinder 10 with its closed end toward the dispensing end of the cylinder and its open end spaced away from the end of the cylinder opposite the dispensing end. It may be seen that the cylinder 10, the ball enclosure 20 and bridges 18 connecting the cylinder to the enclosure are a single unitary element which can be economically molded using any suitable material, such as a polypropylene plastic, for example.

The ball enclosure 20 is situated within the cylinder and spaced apart from the cylinder side wall by a plurality of bridges 18 which connect a side wall portion 22 of the enclosure with the inner surface of the cylinder side wall. In this preferred embodiment, eight such connecting bridges are shown, but the number required to function as connectors of the enclosure to the housing is a matter of choice. The bridges are shown as having a substantially rectangular cross section and extending for the full length of the enclosure side wall 22, but neither the shape nor the extent of the bridges is critical to the invention.

A ball 30 is contained within the enclosure 20. The ball may be made from any material, such as glass, for example, which has sufficient density to operate as the sole movable portion of the valve of this invention, as will be explained later.

A planar circular ball check valve seat 40 having a central opening 42 is disposed between the housing 10 and the mouth of bottle 50 with the central opening 42 in coaxial alignment with the enclosure 20 to afford an opening and closing valve portion of the fitment. The housing 10 and valve seat 40 are held in sealing engagement with the bottle 50 by the closure 60, as will be explained later. The outside diameter of the valve seat 40 is at least greater than the diameter of the annular wedge 14 on the housing 10, and the diameter of the central opening 42 is less than the diameter of the ball 30 to permit only a partial passage of the ball therethrough, as will be explained later.

In this preferred embodiment, the wall structure of the enclosure 20 is shown as continuous; that is, there are no openings, slots or the like through the wall. Although openings through the wall might facilitate dispensing liquids from the bottle's interior, such openings could also make it easier to manipulate the ball by insertion of a probe through the opening in order to add liquid into the bottle through the fitment and, therefore, openings through the wall are not preferred.

Also, in this preferred embodiment, the cup-shaped wall is shown as having a cylindrical side wall portion, a planar end portion, and a frustoconical connecting wall portion. It is apparent that for the purposes of this invention the precise configuration of the cup-shaped portion is largely a matter of choice. The cup-shaped portion could be hemispherical, parabolical, or have an octagonal or hexagonal cross section, for example, and function in substantially the same manner as the structure described in the preferred embodiment. References in the description and claims to a cup-shaped enclosure of this invention are intended to include any shape equivalent to the shape described in this preferred embodiment whether having openings, slots or the like or not. For purposes of this invention, it is only necessary that the enclosure wall be capable of retaining the ball within the enclosure and permitting the ball to roll freely away from the valve seat opening when the bottle is tipped in order that liquids may be freely dispensed from the bottle.

To assemble this preferred embodiment of a non-refillable pour fitment of this invention with a bottle, a bottle 50, having liquid contained therein, is provided and the valve seat 40 is positioned across the open mouth of the bottle with the center of the valve seat opening 42 coincident with the center of the bottle mouth. The valve seat 40 is supported by the rim surface 52 of the bottle wall surrounding the bottle mouth. The ball 30 is then placed upon the opening 42 of the valve seat 40 and, as may be seen in FIG. 4, it is preferable that the valve seat opening 42 be only slightly less than the diameter of the ball 30 to allow a significant portion of the ball 30 to be within the opening. Such a relationship between the diameters of the valve seat opening 42 and ball 30 provides a more secure seat for the ball as well as maximizing the size of the opening to facilitate dispensing the bottle content. As may be seen in FIG. 4, a valve seat element of a fitment of this invention must be of sufficient strength and rigidity to support the ball 30 and not permit passage of the ball through the opening 42. At least one material suitable for use as the valve seat 40 is a low density polyethylene, such as a polyethylene containing 10% EVA therein, and without undue experimentation, one skilled in the art can determine a suitable thickness of material necessary for use with a particular size of bottle and particular weight of a ball 30.

Having the valve seat 40 and ball 30 thus positioned upon the bottle, the cylinder 10 with the ball enclosure 20 contained therein and connected thereto, as has been previously described, is positioned over the ball and valve seat with the center of the cylinder and enclosure coincident with the center of the bottle mouth and with the annular wedge 14 of the housing resting upon a portion of the upper surface of the valve seat.

To securely attach the fitment of this invention, as has just been described, with the bottle, a metal closure 60 is provided.

Figure 4:
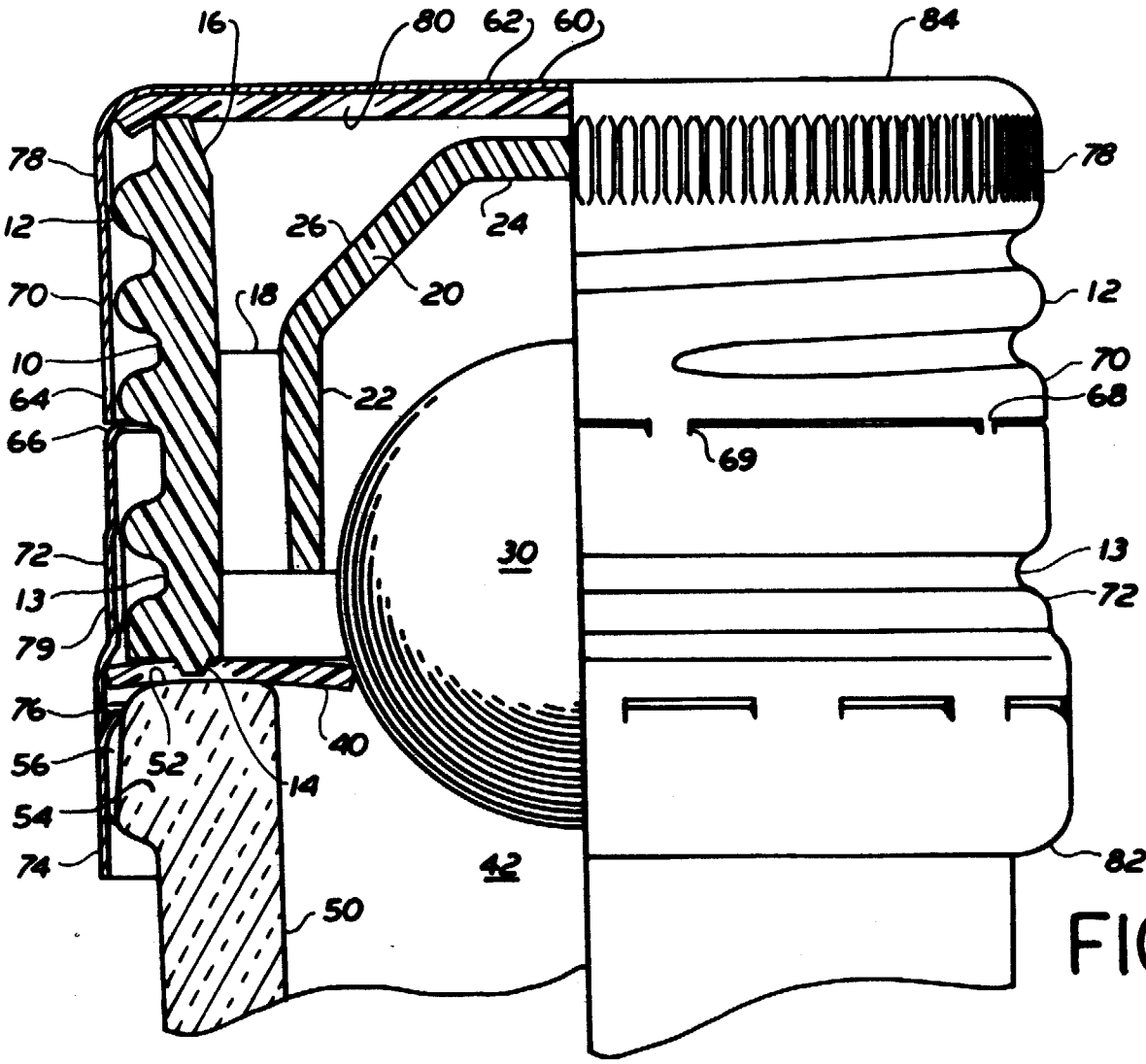
FIG. 4 is a partial cross section of a fitment of this invention assembled with a bottle by the use of a closure suitable for such assembly and a partial side view of such a closure assembled with the fitment and bottle.
Figure 6:
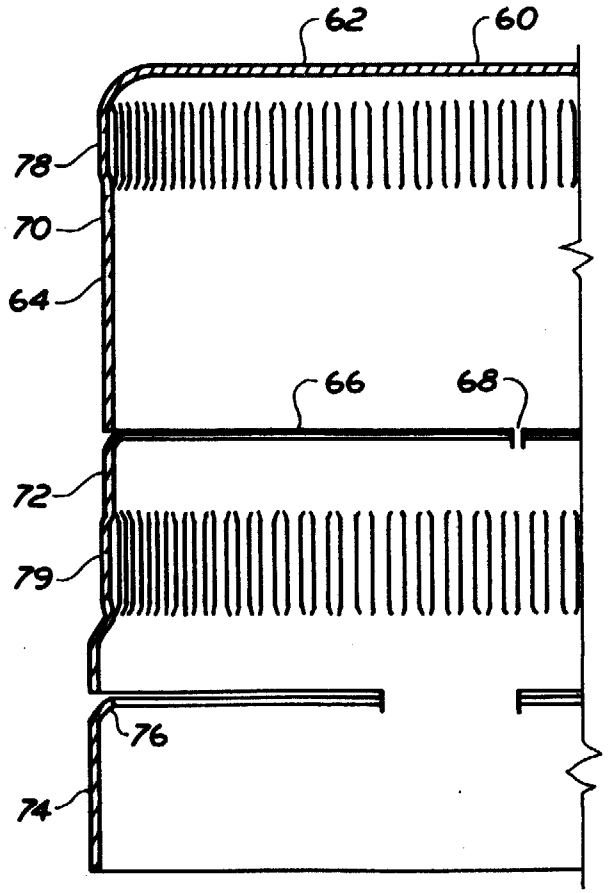
FIG. 6 is an as-produced closure suitable for assembly with a bottle and a fitment of this invention.
Figure 5:
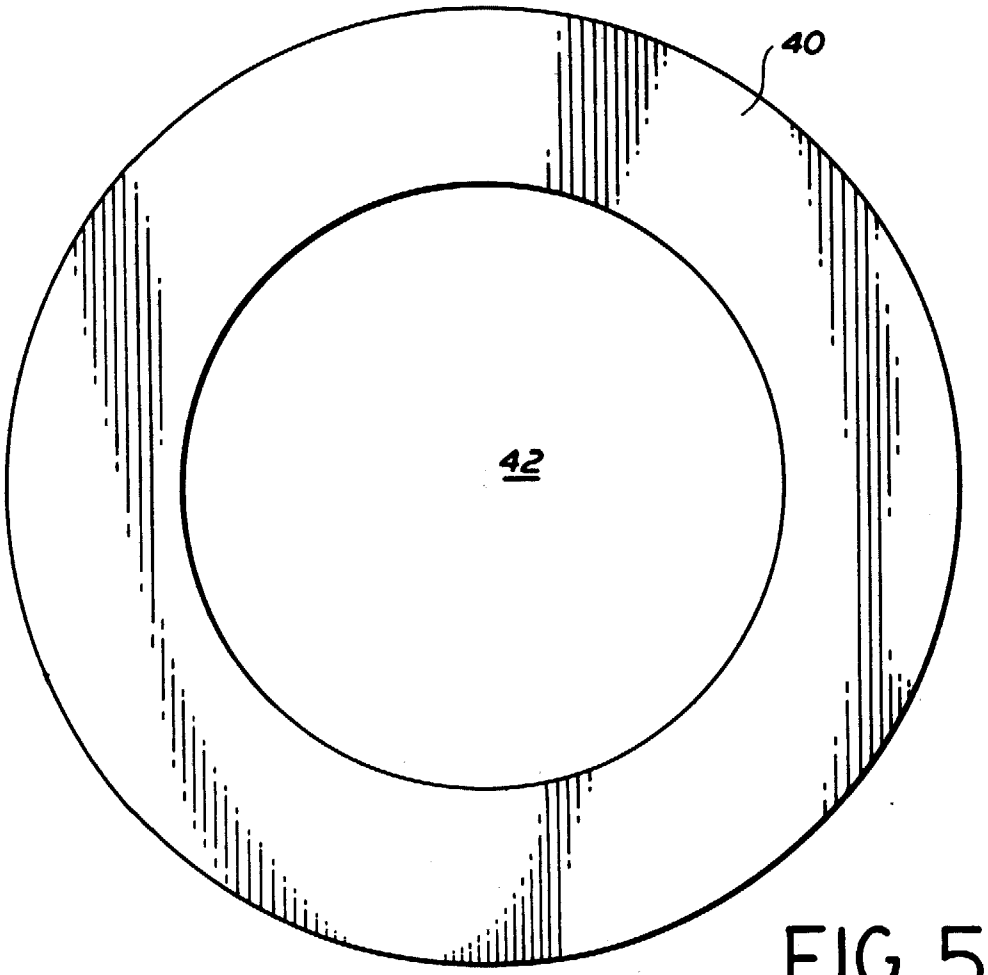
FIG. 5 is a top view of a ball check valve seat included in a fitment of this invention.

As shown in FIG. 6, the metal closure, prior to assembly, is comprised of a planar circular end wall 62 and depending skirt 64. The depending skirt 64 is substantially cylindrical and includes therein a line of weakness 66 in a portion of the skirt which lies between a first portion 70 which is rolled to engage the threads 12 on the fitment cylinder 10 as shown in FIG. 4 and a second portion 72 which is rolled to engage the annular groove 13 on the fitment cylinder 10 and functions as a sleeve to maintain the fitment and bottle in engagement, as will be explained later. The line of weakness 66 is provided by making an annular slit in the skirt 64 except for a plurality of unslit portions equally spaced around the circumference of the skirt wall. The unslit portions or bridges 68 thus serve as connections between the first and second skirt portions 70, 72. In this preferred embodiment, six bridges 68 are provided, all of equal size except for one which is greater in width than the remaining five. For purposes of this invention, however, as will be explained later, the number and width of the bridges 68 are a matter of choice except that it is preferred that at least one of the bridges is greater in width than the remaining bridges.

On a third portion 74 of the closure 60, near the open end, a plurality of inwardly projecting tongues 76 are provided. In this preferred embodiment, six such tongues 76 are provided, but the number of tongues needed for purposes of this invention is a matter of choice, as will be explained later. To facilitate removal of the portion of the closure 60 above the line of weakness 66 after assembly with the fitment housing 10 and bottle 50, as will now be explained, knurled surfaces 78 are provided on the first skirt portion 70. Knurled surfaces 79 are also provided on the second skirt portion 72 to assist in preventing rotation of the second skirt portion when the upper portion of the closure 60 is being removed, as will be explained later.

To effect assembly of closure 60 with the housing 10 and bottle 50, the closure 60, as just described, is provided with a suitable liner 80 adjacent to the interior surface of the closure end wall 62 and is then positioned, as shown in FIG. 4, with the closure 60 surrounding the housing 10 and a portion of the bottle adjacent to the bottle mouth. The bottle 50 is provided with an annular flange 54 projecting outwardly from the bottle wall adjacent to the rim edge 52 surrounding the bottle mouth. Coincident with the spacing of the inwardly projecting flanges 76 of the closure 60, outwardly projecting lugs 56 are provided around the outer surface of the bottle flange 54. To facilitate alignment of the closure flanges 76 with the lugs 56, the lugs may be of a considerably lesser width than the closure flanges.

By a known method, portions of the closure skirt 64 are formed by rollers to conform the skirt to the housing thread 12 and the annular groove 13, and a portion 82 of the skirt adjacent to the open end of the closure is bent inwardly under the bottle flange 54.

Figure 12:
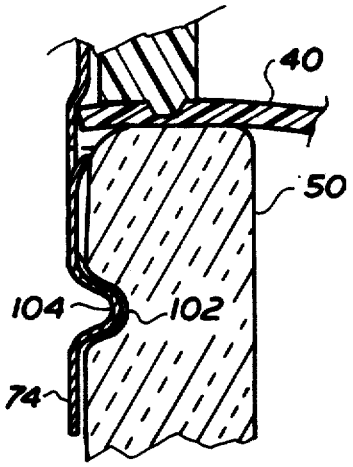
FIG. 12 is a partial cross-sectional view of an alternate embodiment of a fitment of this invention having a portion of the closure skirt extending beyond the line of attachment between the closure and the bottle.

It may be seen that in forming the first skirt portion 70 to conform to thread 12 and forming the second skirt portion 72 to engage the annular groove 13, the bridges 68 are subject to a tensile force, and unless the bridges are of sufficient width, such tensile force will cause the bridges to fracture. Providing bridges 68 of sufficient width to resist fracture from such tensile force, however, is disadvantageous to facilitate removal of the closure because the greater the width of the bridges, the greater is the amount of torque required to break the bridges when removing the closure. By providing at least one bridge 69 having a width sufficient to provide a bridge with a cross section sufficient to withstand the tensile force without breaking, one or all of the remaining bridges may fracture without detriment to the function of the closure. As long as one bridge remains intact upon application of the closure, such a bridge is available to provide evidence that the closure has not been removed from the bottle. Thus, it may be seen that the smallest of the bridges provided need be only of a width sufficient to maintain assembly of the first and second portions 70, 72 of the skirt wall prior to engaging the closure with the housing 10. If desired, the third skirt portion 74 can be extended below the bent-in portion. Referring to FIG. 12, the bottle 50 has an annular groove 102 near the mouth of the bottle, and an annular ridge 104 on the third skirt portion 74 of the closure is rolled into the groove. As may be seen from FIG. 12, this alternate embodiment makes it possible to extend the skirt to any desired length.

During bending of the skirt portion 82 under the bottle flange 54, the closure 60 is drawn down tightly to compress the portion of the liner 80 disposed between the end wall 62 of the closure and the surface of the rim edge of the dispensing end of the housing 10. Drawing down the closure 60 in the aforesaid manner also causes the annular housing wedge 14 to embed into and compress the portion of the ball check seat 40 disposed between the wedge and the rim surface 52 of the bottle. Compression of the liner 60 and ball check seat 40, as just described, provides an effective seal between the closure 60 and fitment cylinder 10 to protect the bottle content.

Bending the skirt wall portion 82 under the bottle flange 54 also functions to assist in maintaining assembly of the fitment with the bottle and breaking the bridges when the closure is removed, as will now be discussed.

To remove the closure 60, the closure is gripped and rotated, usually in a counterclockwise direction, with sufficient torque to break the bridges 69, 68 that have remained intact after assembling the closure with the fitment housing 10 and bottle 50, as has previously been described. The number and sizes of bridges 68, 69 necessary to provide an adequate connection between the first and second skirt portions 70, 72, both before and after assembling the closure with the fitment cylinder 10 and bottle 50, are a function of such things as the bottle diameter and the depth and extent of the thread 12 balanced against a reasonable torque requirement to remove the closure. The number and sizes of bridges 68, 69 can be determined for each specific application of this invention without undue experimentation.

As was noted earlier, bending the skirt wall portion 82 under the bottle flange 54 is of benefit in assisting to maintain an assembly of the fitment with the bottle and breaking the bridges upon removal of the closure. Forming the second portion of the skirt 72 into the annular groove 13 of the cylinder 10 when the closure is applied to the housing prevents the second skirt portion from moving vertically when the closure is rotated for removal. Engagement of the second skirt portion 72 into the annular groove 13 may also provide some assistance against rotation of the second skirt portion due to the frictional resistance between the housing groove and the skirt portion engaged therein. Additional resistance to rotation may be provided by including vertical grooves in the outwardly projecting cylinder portions adjacent the annular groove 13 for engagement with the knurls 79. It is desirable to prevent rotation of the second skirt portion 72 to aid in breaking the bridges 68, 69. As may best be seen in FIG. 4, when the closure is positioned over housing 10 and bottle 50 prior to assembly therewith, the closure is oriented in a manner such that closure flanges 76 overlay the outwardly projecting bottle lugs 56. When skirt portion 82 is bent under bottle flange 54 and drawn down in the process thereof, the closure flanges 76 are forced into a binding contact with lugs 56, and thus the second skirt portion 72 is restrained from rotation to assist breaking the bridges 68, 69 and facilitate removal of the portion 84 of the closure above the weakened line 66.

With the upper portion 84 of the closure removed, housing 10 is held in assembly with the bottle 50 by the closure skirt portions engaged with annular groove 13 and bottle flange 54, and content of the bottle may now be dispensed in a usual pouring manner.

Figure 8:
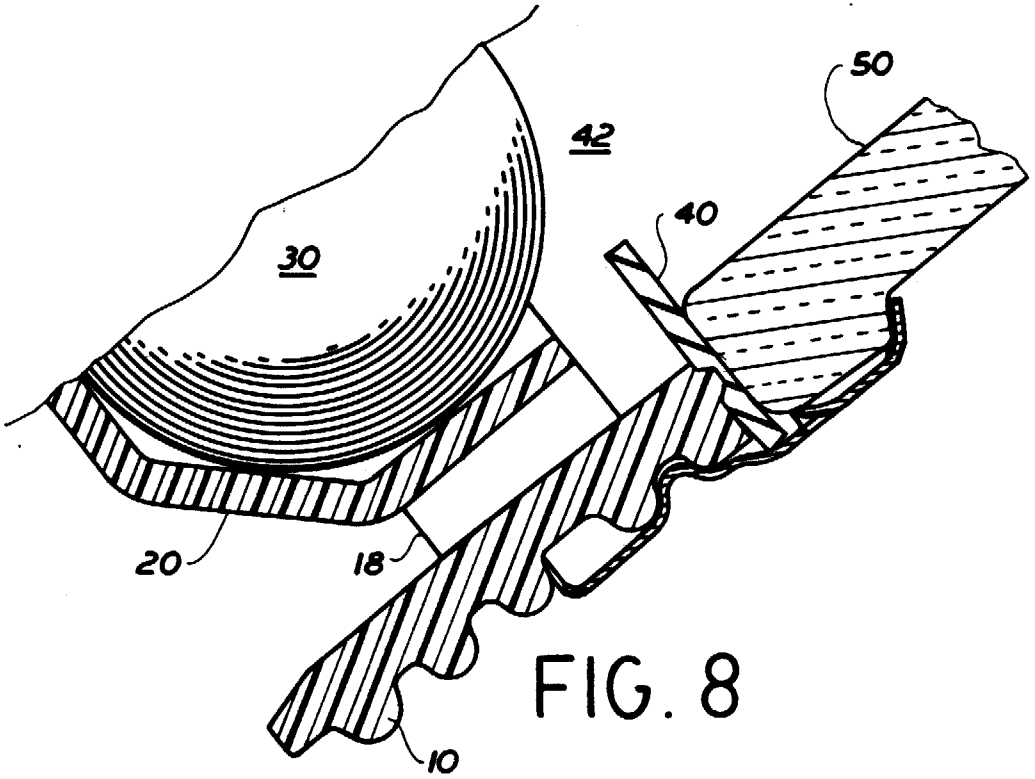
FIG. 8 is a partial cross section of a fitment of this invention assembled with a bottle, the assembly tilted at an angle sufficient to dispense a liquid from the bottle.
Figure 7:
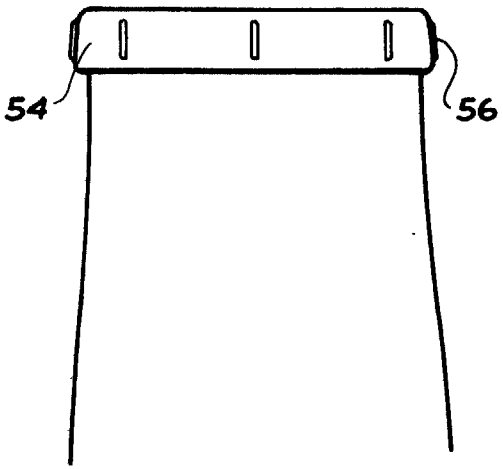
FIG. 7 is a side view of an upper portion of a bottle suitable for use with a preferred embodiment of this invention, the view showing lugs projecting outwardly from a flange adjacent to the bottle mouth.

FIG. 8 shows the bottle 50 tipped at an angle sufficient to cause liquid content of the bottle to flow therefrom. The particular angle will vary with the amount of liquid in the bottle, but for convenience, the bottle is shown in FIG. 8 tipped at an outside angle of approximately 135° with vertical.

Under the influence of gravity, ball check 30 has rolled away from ball check seat 40 and clears opening 42 thereby. Ball check 30 is enclosed and restrained from escape by ball check enclosure 20 in a manner that the flow of liquid is unimpeded through the valve seat opening 42. Liquid is thus free to flow through the opening 42 and thence through the space separating the housing 10 from the enclosure 20 and then out the dispensing end of the housing.

When the desired amount of liquid has been dispensed, the bottle 50 is returned to vertical and ball check 30, under the influence of gravity, returns to the valve check position shown in FIG. 4. It may be seen that even though the upper part 84 of the closure has been removed, the ball check 30 is not readily susceptible to manipulation, and thus a fitment of this invention provides an effective device to prevent fraudulent refilling of a bottle. It also may be noted that a fitment of this invention includes only one moving part, ball check 30, and since it is preferably made of glass or some other such relatively dense material, the ball check is not apt to become stuck to the valve seat 40 even if a syrupy or other such sticky liquid is being dispensed from the bottle.

Figure 9:
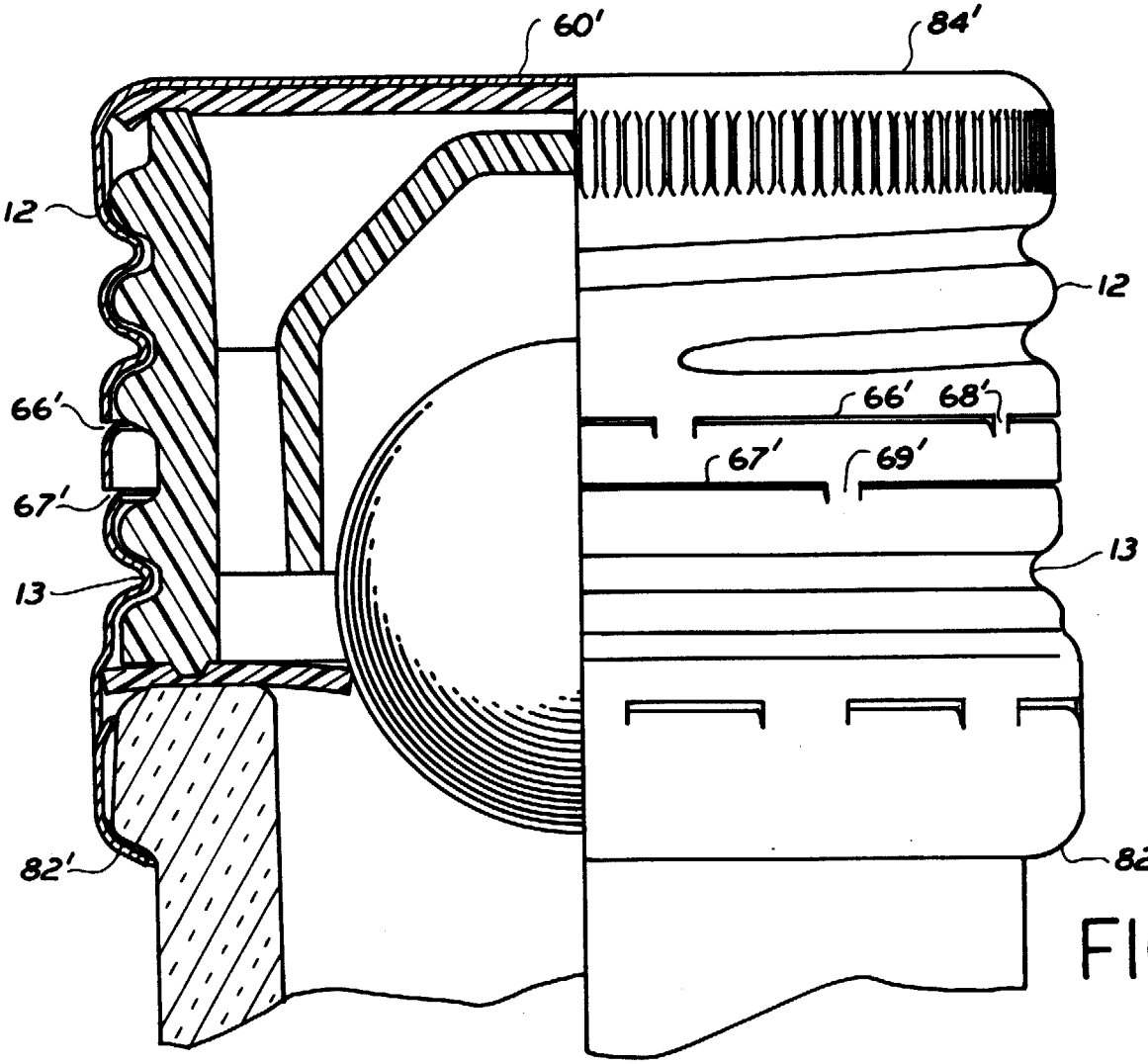
FIG. 9 is the same view as that shown in FIG. 4 with an alternate closure embodiment.

An alternate closure 60' suitable for use in attaching a fitment of this invention to a bottle 50 is shown in FIG. 9. The alternate closure 60' is similar in all respects to closure 60 described in the foregoing discussion of a preferred embodiment except that the alternate closure 60' includes, in addition to weakened line 66', a second weakened line 67'. In this alternate embodiment 60', the first weakened line 66' is comprised of an annular slit in an upper portion of skirt 70' except for a plurality of spaced apart bridges 68'. The second weakened line 67' is comprised of an annular slit spaced apart from the first weakened line 66', the slit being completely circumferential except for a plurality of bridges 69' which are spaced intermediate of the bridges 68' in the first weakened line 66'. The bridges 69' in the second weakened line 67' are of a greater width than the bridges 68' in the first weakened line 66'.

In using an alternate closure 60' to secure a fitment of this invention to a bottle, it is positioned and formed to engage the bottle thread 12 and annular groove 13 in a manner identical with that previously discussed in applying the closure 60 to a preferred embodiment of the invention.

Again, it may be seen that the relatively severe forming required to thread roll, engage the skirt into the annular groove 13 and bend a portion 82' under bottle flange 54 induces a substantial tensile stress in the bridges 68', 69'. By staggering the bridges 68' in weakened line 66' with reference to bridges 69' in weakened line 67', however, the tensile stress is accommodated by opening the slit portions of lines 66', 67' opposite the bridges 68', 69' rather than fracturing the bridges. Since the bridges 69' in line 67' are wider than the bridges 68' in line 66', it may be seen that when torque is applied to remove an upper portion 84' of the closure, the narrower bridges 68' fracture preferentially, and separation is effected along line 66'. The number, size and spacing of the bridges, as well as spacing of the lines of weakness, are a function of such things as the size of the closure, depth of the thread, and depth of the annular groove in the fitment housing, for example, and such features can be determined for specific use applications without undue experimentation.

In the just described preferred embodiment, the valve seat 40 is held in sealing engagement by being held in compression between the end surface of the cylinder 10 and the end surface 52 of the bottle wall adjacent to the bottle mouth by the gripping action of the sleeve portion 72 of the closure 60 on the cylinder and bottle.

Figure 10:
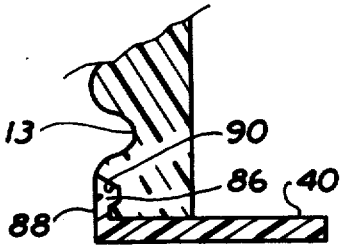
FIG. 10 is a partial cross sectional view of an assembly of the valve seat and housing of a fitment of this invention.

In an alternate embodiment, the valve seat 40 may be mechanically interlocked with the cylinder 10, as shown in FIG. 10, which would permit the fitment assembly to be made prior to attachment to the bottle. In the interlocking detail shown in FIG. 10, the valve seat 40 is provided with an annular rib 86 projecting inwardly from an annular side wall 88 around the peripheral edge of the valve seat. The interlocking assembly is made by snapping the rib 86 into an annular groove 90 provided near the end of the lower portion 17 of the cylinder 10. It is apparent that other interlocking fits could also be suitable for pre-assembly of the fitment, if desired. For example, instead of the snap fit between the cylinder 10 and valve seat 40, shown in FIG. 10, a threaded connection between the cylinder and valve seat could be made.

Figure 11:
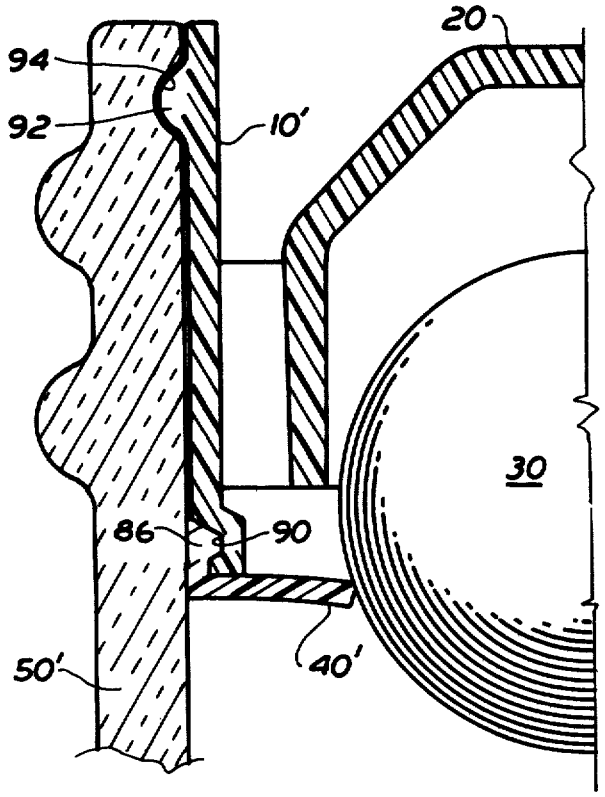
FIG. 11 is a partial cross sectional view of an alternate embodiment of a fitment of this invention assembled with a bottle.

Also in the foregoing description of a preferred embodiment of this invention, the cylinder 10 was adapted to assemble with the bottle 50 with the cylinder wall in substantial alignment with the wall surrounding the bottle mouth. In an alternative embodiment as shown in FIG. 11, the valve seat 40 is assembled with the cylinder 10' using a snap fit between the valve seat rib 86 and cylinder groove 90. The fitment assembly comprising the valve seat 40', ball 30, ball enclosure 20, bridges 18 and cylinder 10' is then inserted into the bottle mouth in the manner of a stopper. Near the dispensing end of the cylinder 10', an outwardly projecting annular ridge 92 is provided to engage an annular groove 94 in the inside surface of the bottle 50' to make it difficult to disengage the fitment once engaged in the bottle. It may also be noted in FIG. 11 that the bottle 50' is adapted to be sealed with threaded engagement of a closure, as is known to those skilled in the art.

While the invention has been described in terms of preferred embodiments, the claims appended hereto are intended to encompass all embodiments which fall within the spirit of the invention.

What is claimed is:

1. A one-piece housing for a ball in a nonrefillable pour fitment for assembly with a bottle having an open mouth to prevent fraudulent refilling of the bottle, the housing comprising:

a hollow cylinder adapted for coaxial assembly with a bottle, the cylinder having a side wall, a receiving end for disposition toward the bottle interior, and a dispensing end for disposition away from the bottle interior;

a ball enclosure having a central axis, a cup-shaped wall adapted to accommodate and retain a ball within the space surrounded by the wall, and an open end defined by a portion of the cup-shaped wall, said enclosure coaxially disposed within said cylinder with the open end of said enclosure disposed away from the dispensing end of said cylinder and spaced apart from the side wall of said cylinder by a plurality of bridges integrally connecting portions of the cylinder side wall with wall portions of said enclosure.

2. The housing described in claim 1 which further includes a ball within said enclosure and a valve seat having a central opening therethrough of a smaller diameter than the diameter of the ball, the valve seat also having a marginal edge and connected along its marginal edge to a portion of the side wall of said cylinder so that the valve seat central opening is in coaxial alignment with and spaced apart from the open end of the enclosure a distance no greater than the diameter of the ball.

3. The housing described in claim 2 wherein the valve seat and the cylinder are adapted for a snap fit connection.

4. The housing described in claim 1 wherein said cylinder is provided with a thread projecting outwardly from a portion of the outer surface of the side wall extending downwardly from the dispensing end to engage with a threaded closure and is further provided with means for engaging a sleeve circumscribing a portion of the cylinder below the thread.

5. The housing described in claim 4 wherein the means for engaging the sleeve is an annular groove to receive a rib projecting outwardly from the inner surface of the sleeve.

6. The housing described in claim 1 wherein said cylinder is provided with an annular wedge projecting outwardly from the edge of the receiving end.

7. A nonrefillable pour fitment assembled with a bottle having an open mouth to prevent fraudulent refilling of the bottle, the assembly comprising:

a hollow cylinder having a side wall, a receiving end disposed toward the bottle interior and a dispensing end disposed away from the bottle interior;

means for coaxially engaging said cylinder with said bottle;

an open end ball enclosure having a central axis and a cup-shaped wall coaxially aligned with said cylinder and disposed within said cylinder with the open end facing toward the receiving end of said cylinder and with the cup-shaped enclosure wall spaced apart from the cylinder side wall by a plurality of bridges integrally connecting portions of the enclosure wall with portions of the cylinder wall;

a ball within said enclosure, said ball having a diameter less than the least space dimension across the open end of said enclosure and said ball retained within said enclosure by a valve seat having a marginal edge and a central opening of a lesser diameter than the diameter of said ball, coaxially aligned with and spaced apart from the open end of said enclosure a lesser distance than the diameter of said ball and having the marginal edge of said valve seat in sealing engagement with a portion of the cylinder side wall near the receiving end of said cylinder and thereby retaining said ball in said enclosure with said ball seated upon the valve seat opening when the bottle is in an upright position and preventing introduction of a liquid into the bottle interior through the fitment.

8. An assembly as described in claim 7 wherein means for engaging said cylinder with said bottle comprises a cylindrical sleeve encasing a lower portion of said cylinder and an upper portion of said bottle and means for engaging said sleeve to said cylinder and for engaging said sleeve to said bottle.

9. An assembly as described in claim 8 wherein means for engaging said sleeve to said cylinder comprises said sleeve having an annular ridge projecting inwardly from an upper portion thereof and said cylinder having an annular groove in a lower portion thereof with the sleeve ridge engaged with the cylinder groove.

10. An assembly as described in claim 8 wherein means for engaging said sleeve to said bottle comprises said bottle having an outwardly projecting flange adjacent the bottle mouth, said sleeve having a lower end portion projecting inwardly and the inwardly projecting sleeve portion engaging the outwardly projecting bottle flange.

11. An assembly as described in claim 8 which further comprises a closure having an end wall and depending skirt with an inwardly projecting thread thereon in threadable engagement with a threaded portion of said cylinder.

12. An assembly as described in claim 11 wherein the skirt of said closure is connected with said sleeve by a wall having therein at least one line of weakness comprising a plurality of bridges connecting the closure skirt with said sleeve with at least one bridge being greater in width than the remaining bridges.

13. An assembly as described in claim 7 wherein means for engaging said cylinder with said bottle comprises said cylinder having a lower stopper portion within the bottle mouth in sealing engagement with the interior side wall surface of said bottle adjacent to the mouth.

14. An assembly as described in claim 7 wherein said cylinder side wall is substantial alignment with the bottle wall surrounding the bottle mouth and the marginal edge portion of said valve seat is compressed between opposing end surfaces of the cylinder side wall and bottle wall.

15. An assembly as described in claim 7 wherein the marginal edge of said valve seat is connected to the cylinder side wall near the receiving end of said cylinder side wall with an interlocking engagement.

* * * * *